US007575102B2

(12) United States Patent
Matsuoka

(10) Patent No.: US 7,575,102 B2
(45) Date of Patent: Aug. 18, 2009

(54) SAFETY DEVICE OF ELEVATOR AND ITS OPERATION TESTING METHOD

(75) Inventor: Tatsuo Matsuoka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 526 days.

(21) Appl. No.: 10/574,602

(22) PCT Filed: Feb. 26, 2004

(86) PCT No.: PCT/JP2004/002250

§ 371 (c)(1),
(2), (4) Date: Apr. 5, 2006

(87) PCT Pub. No.: WO2005/082765

PCT Pub. Date: Sep. 9, 2005

(65) Prior Publication Data

US 2007/0007087 A1 Jan. 11, 2007

(51) Int. Cl.
*B66B 3/00* (2006.01)

(52) U.S. Cl. ..... 187/391; 187/393

(58) Field of Classification Search ..... 187/209, 187/223, 287, 391, 393
See application file for complete search history.

(56) References Cited

U.S. PATENT DOCUMENTS 3,579,048 A * 5/1971 Auffret ..... 361/189
4,380,049 A * 4/1983 Makinen ..... 701/70
5,407,028 A * 4/1995 Jamieson et al. ..... 187/288
5,648,644 A * 7/1997 Nagel ..... 187/288
6,056,088 A * 5/2000 Gerstenkorn ..... 187/390
6,173,813 B1 * 1/2001 Rebillard et al. ..... 187/287
6,446,760 B1 * 9/2002 Lisi ..... 187/391
2005/0269163 A1 * 12/2005 Angst ..... 187/287

FOREIGN PATENT DOCUMENTS

JP 55-135078 10/1980
JP 2-152886 6/1990
JP 7-117945 5/1995
JP 2001-106446 4/2001

OTHER PUBLICATIONS

JP1980135078ATRANS.pdf: English translation of Japanese publication JP 55-135078.*

* cited by examiner

*Primary Examiner*—Bentsu Ro
*Assistant Examiner*—Kawing Chan
(74) *Attorney, Agent, or Firm*—Oblon, Spivak, McClelland, Maier & Neustadt, P.C.

(57) ABSTRACT

In an elevator safety device, a brake device puts brakes to brake a car through an operation of a safety relay main contact provided to a safety circuit. When the car stops during normal operations, a safety relay instruction signal for operating the relay main contact to such a direction that the brake device puts brakes is generated from a detection circuit. Then, the detection circuit detects whether or not the safety relay main contact is operated in accordance with the safety relay instruction signal.

12 Claims, 2 Drawing Sheets

SAFETY DEVICE OF ELEVATOR AND ITS OPERATION TESTING METHOD

TECHNICAL FIELD

The present invention relates to an elevator safety device for activating a brake device to brake a car to a stop in case of abnormal elevator operations, and a method of testing an operation thereof.

BACKGROUND ART

For example, a conventional safety circuit for an elevator installation as disclosed in JP-A 2001-106446 includes plural series-connected switches that operate in response to detection of any abnormality. When at least one switch operates, a signal for controlling an elevator is generated.

However, in the case where the switch is kept closed for a long time and resultingly welded at a contact, there is a possibility that the switch cannot be opened at the contact even though an abnormal elevator operation is detected, resulting in delayed or failed output of a control signal for an abnormality.

DISCLOSURE OF THE INVENTION

The present invention has been made to solve the above-described problem, and it is therefore an object of the present invention to provide an elevator safety device capable of detecting an abnormality at a contact and improving a reliability, and a method of testing an operation thereof.

To this end, according to one aspect of the present invention, there is provided an elevator safety device, comprising: a safety circuit including a safety relay main contact for operating a brake device for braking a car; and a detection circuit for generating, when the car stops during a normal operation, a safety relay instruction signal for operating the safety relay main contact to such a direction that the brake device puts brakes, and for detecting whether or not the safety relay main contact is operated in response to the safety relay instruction signal.

According to another aspect of the present invention, there is provided a method of testing an operation of an elevator safety device that includes a safety relay main contact for operating a brake device for braking a car, comprising: a stop detection step of detecting a state where the car stops during a normal operation; a test instruction step of generating, when the car stops, a safety relay instruction signal for operating the safety relay main contact to such a direction that the brake device puts brakes; and an abnormality detection step of detecting whether or not the safety relay main contact is operated in response to the safety relay instruction signal.

BEST MODE FOR CARRYING OUT THE INVENTION

Hereinafter, a preferred embodiment of the present invention will be described with reference to the accompanying drawings.

Figure 1:
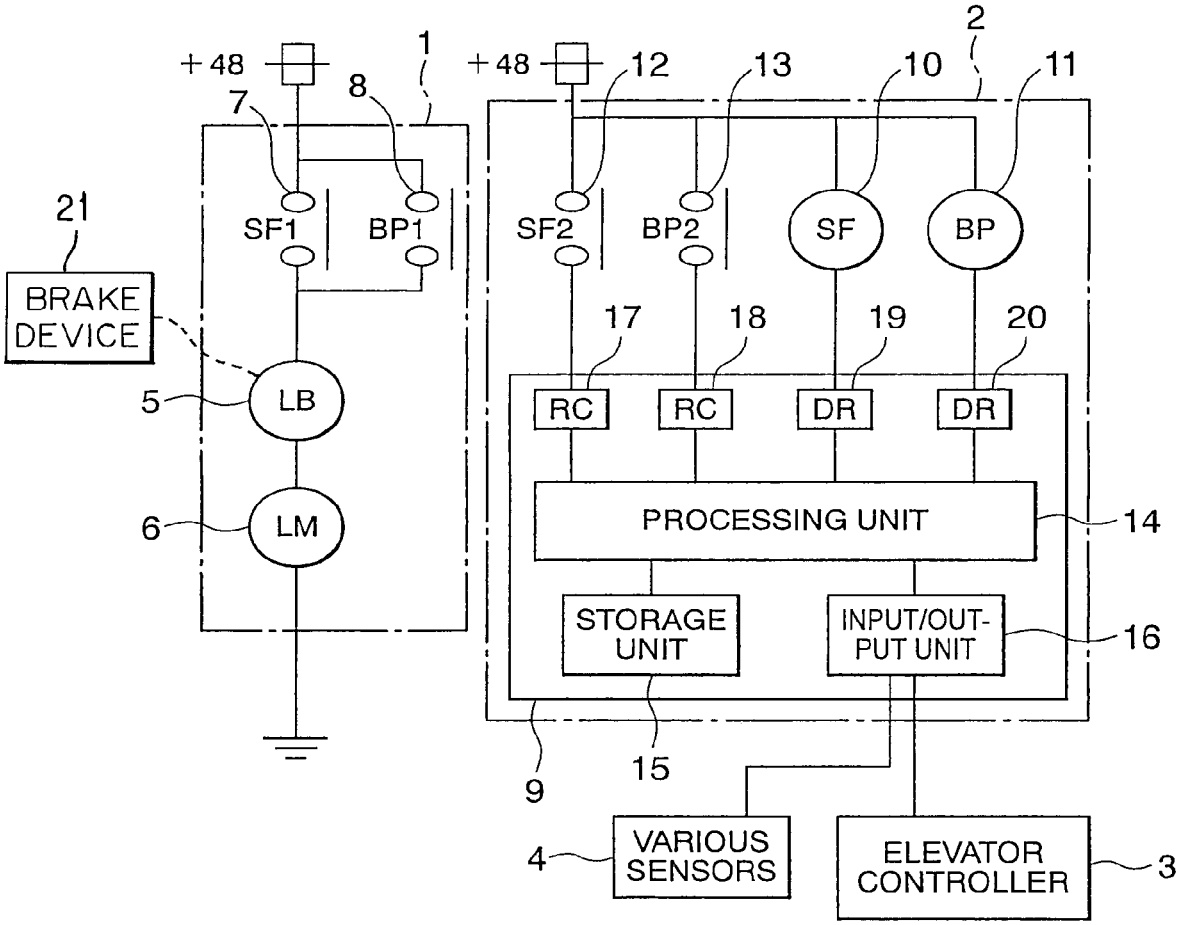
FIG. 1 is a circuit diagram of an elevator safety device according to an embodiment of the present invention.

FIG. 1 is a circuit diagram of an elevator safety device (electronic safety device) according to an embodiment of the present invention. The safety device includes a safety circuit 1 for stopping the movement of a car (not shown) when an abnormal elevator operation is detected, and a detection circuit 2 for detecting an abnormal elevator operation. The detection circuit 2 is electrically connected to an elevator controller 3 for controlling an elevator operation and to various sensors 4.

Examples of the various sensors 4 include a speed sensor (e.g., encoder) for detecting a moving speed of a car, and a positional sensor for detecting a position of the car.

A car and a balance weight (not shown) ascends and descends in a hoistway by means of driving force of a hoisting machine (not shown). The hoisting machine is controlled by the elevator controller 3. The hoisting machine is provided with a drive sheave around which a main rope suspending the car and balance weight winds, a hoisting machine motor for rotating the drive sheave, and a brake device 21 for braking the rotation of the drive sheave.

The safety circuit 1 includes: a brake power supply contactor coil 5 for supplying power to the brake device 21; a motor power supply contactor coil 6 for supplying power to the hoisting machine motor; a safety relay main contact 7 that switchingly allows/disallows voltage application to the contactor coils 5 and 6; and a bypass relay main contact 8 parallel-connected with the safety relay main contact 7.

The brake power supply contactor coil 5, the motor power supply contactor coil 6, and the safety relay main contact 7 are series-connected with one another with respect to the power supply. The safety relay main contact 7 is closed during normal operations. The safety relay main contact 7 is opened under abnormal elevator operations, for example, under such a condition that the car moves at a speed above a preset speed. The bypass relay main contact 8 is open during normal operations.

The detection circuit 2 includes a detection circuit main body 9, a safety relay coil 10 for operating the safety relay main contact 7, a bypass relay coil 11 for operating the bypass relay main contact 8, a safety relay monitor contact 12 that closes/opens mechanically in conjunction with the safety relay main contact 7, and a bypass relay monitor contact 13 that closes/opens mechanically in conjunction with the bypass relay main contact 8.

The safety relay coil 10, the bypass relay coil 11, the safety relay monitor contact 12, and the bypass relay monitor contact 13 are parallel-connected with one another with respect to the detection circuit main body 9.

The safety relay main contact 7 and the safety relay monitor contact 12 are mechanically connected by means of a linking mechanism (not shown). If either one of the contacts 7 and 12 comes to an inoperative state because of being welded and such, the rest accordingly becomes inoperative.

The bypass relay main contact 8 and the bypass relay monitor contact 13 are mechanically connected by means of a linking mechanism (not shown). If either one of the contacts 8 and 13 comes to an inoperative state because of being welded and such, the rest accordingly becomes inoperative.

The detection circuit main body 9 includes a processing unit 14, a storage unit 15, an input/output unit 16, a safety relay monitor contact receiver circuit 17, a bypass relay monitor contact receiver circuit 18, a safety relay driver circuit 19, and a bypass relay driver circuit 20.

A CPU is used as the processing unit 14, for example. A RAM, ROM, or hard disk drive is used as the storage unit 15, for example. The storage unit 15 stores, for example, data for judging an abnormality of an elevator or a program for testing an operation of the safety relay main contact 7.

The processing unit 14 transmits/receives signals to/from the elevator controller 3 and the various sensors 4 through the input/output unit 16.

The safety relay monitor contact receiver circuit 17 is series-connected with the safety relay monitor contact 12 to detect open/close states of the safety relay monitor contact 12. The bypass relay monitor contact receiver circuit 18 is series-connected with the bypass relay monitor contact 13 to detect open/close states of the bypass relay monitor contact 13.

The safety relay driver circuit 19 is series-connected with the safety relay coil 10 to switch the safety relay coil 10 between an excited state and a non-excited state. The bypass relay driver circuit 20 is series-connected with the bypass relay coil 11 to switch the bypass relay coil 11 between an excited state and a non-excited state.

The safety relay coil 10 is switched between the excited state and the non-excited state by the processing unit 14 outputting a safety relay instruction signal to the safety relay driver circuit 19. The bypass relay coil 11 is switched between the excited state and the non-excited state by the processing unit 14 outputting a bypass relay instruction signal to the bypass relay driver circuit 20.

The receiver circuits 17, 18 and the driver circuit 19, 20 are parallel-connected with each other with respect to the processing unit 14.

Note that the safety circuit 1 and the detection circuit 2 are applied with a voltage of 48 V, for example.

Next, operations thereof will be described. During an elevator operation, the detection circuit main body 9 monitors presence/absence of an abnormality of an elevator based on information from the various sensors 4. The processing unit 14 detecting the abnormal elevator operation, the safety relay driver circuit 19 stops driving the safety relay coil 10.

With this operation, the safety relay main contact 7 is opened to cut off the current supply to the contactor coils 5 and 6. As a result, the brake device brakes the rotation of the drive sheave and in addition, current supply to the hoisting machine motor is cut off to thereby bring the car to an emergency stop.

Figure 2:
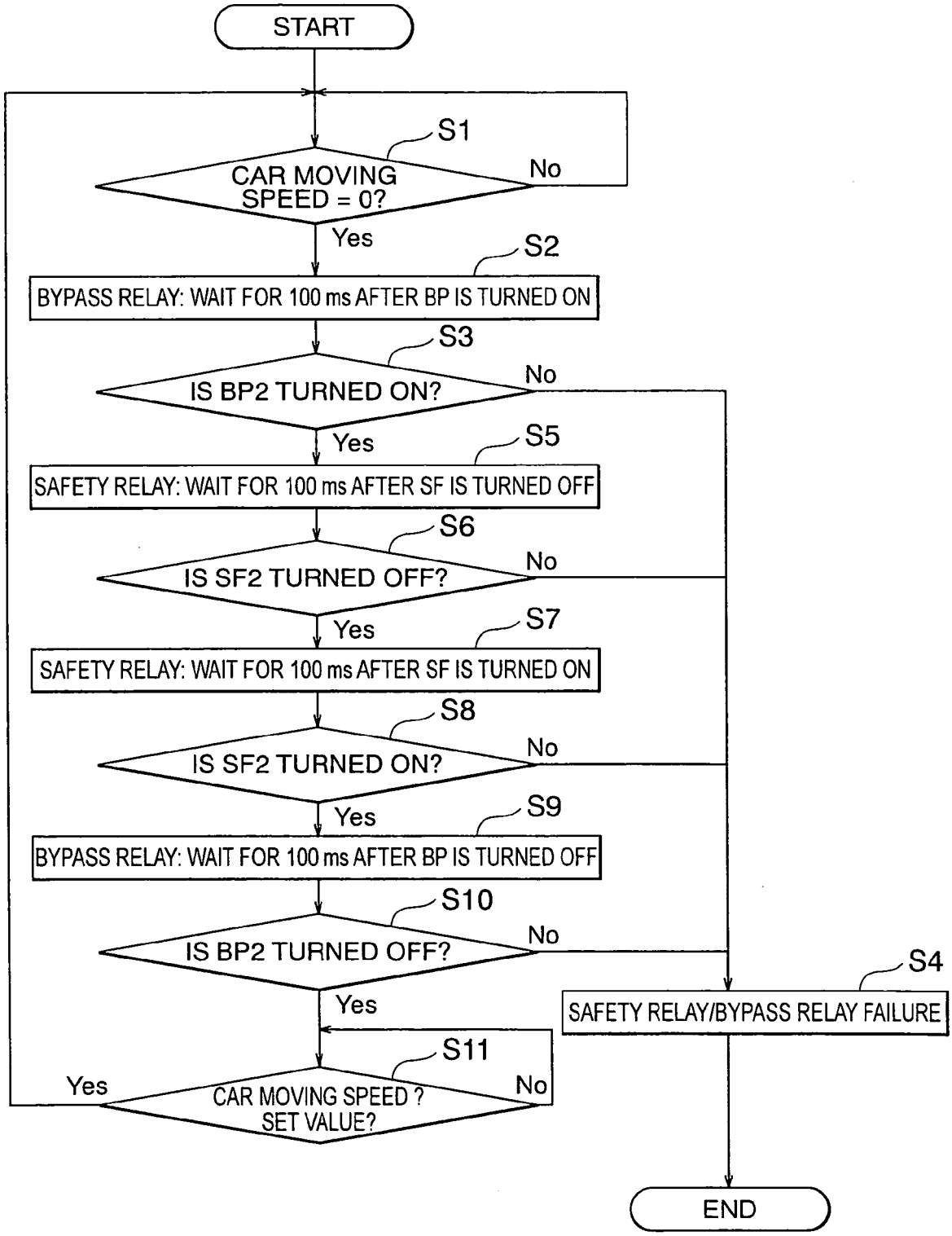
FIG. 2 is a flowchart illustrative of a method of testing an operation of a safety relay main contact of FIG. 1.

Next, a method of testing an operation of the safety relay main contact 7 will be described. FIG. 2 is a flowchart illustrative of the method of testing an operation of the safety relay main contact 7 of FIG. 1. In this embodiment, an operation test is executed each time the car arrives at any floor and stops there during normal operations. Accordingly, during the normal operations, the processing unit 14 monitors whether or not the moving speed of the car reaches zero, based on the information from the various sensors 4 (stop detection step S1).

After the moving speed of the car reached zero and its safety was confirmed, the bypass relay driver 20 excites the bypass relay coil 11, followed by a preset standby time, in this case, 100 ms (step S2). Then, the bypass relay monitor contact receiver circuit 18 checks whether or not the bypass relay monitor contact 13 is closed (step S3).

If the bypass relay monitor contact 13 is not closed, it follows that the bypass relay main contact 8 is not closed. Hence, the processing unit 14 judges the bypass relay to involve a failure, and the detection circuit main body 9 outputs an abnormality detection signal to the elevator controller 3 (step S4).

If confirming that the bypass relay monitor contact 13 is normally closed, the safety relay driver circuit 19 excites the safety relay coil 10, followed by a preset standby time, in this example, 100 ms (test instruction step S5). Then, the safety relay monitor contact receiver circuit 17 checks whether or not the safety relay monitor contact 12 is opened (abnormality detection step S6).

If the safety relay monitor contact 12 is not opened, it follows that the safety relay main contact 7 is not opened because of being welded and such. Hence, the processing unit 14 judges the safety relay to involve a failure, and the detection circuit main body 9 outputs an abnormality detection signal to the elevator controller 3 (step S4).

If confirming that the safety relay monitor contact 12 is normally opened, the safety relay coil 10 is in turn brought into a non-excited state, followed by a preset standby time, in this example, 100 ms (step S7). Then, the safety relay monitor contact receiver circuit 17 checks whether or not the safety relay monitor contact 12 is closed (step S8).

If the safety relay monitor contact 12 is not closed, the processing unit 14 judges the safety relay to involve a failure, and the detection circuit main body 9 outputs an abnormality detection signal to the elevator controller 3 (step S4).

If confirming that the safety relay monitor contact 12 is normally closed, the bypass relay coil 11 is brought into a non-excited state, followed by a preset standby time, in this example, 100 ms (step S9). Then, the bypass relay monitor contact receiver circuit 18 checks whether or not the bypass relay monitor contact 13 is opened (step S10).

If the bypass relay monitor contact 13 is not opened, the processing unit 14 judges the bypass relay to involve a failure, and the detection circuit main body 9 outputs an abnormality detection signal to the elevator controller 3 (step S4).

After the completion of testing the opening/closing operations of the safety relay main contact 7 and bypass relay main contact 8 as described above, the controller waits for the car moving speed to reach a preset value or higher (step S11), and then monitors the moving speed until the car stops (step S1) Each time the car stops, the above operation test is effected to confirm the normal operation of the safety circuit 1.

In the above elevator safety device, the operation test of the safety relay main contact 7 is executed by making use of a timing when the car stops during the normal operations, so the abnormality of the safety relay main contact 7 can be detected without affecting normal operations to improve the reliability.

Also, the operation test is carried out each time the car stops, so the operation of the safety relay main contact 7 can be checked with sufficient frequencies, attaining a much higher reliability.

Further, when the operation test of the safety relay main contact 7 is effected, the bypass relay main contact 8 is closed, making it possible to prevent the current supply to the safety circuit 1 from being cut off during the operation test and to effect the operation test with the safety circuit 1 being kept stably.

Moreover, it is also checked whether or not the safety relay main contact 7 and the bypass relay main contact 8 return to normal, making the reliability still higher.

Note that in the above example, the case where the brake device puts brakes when the safety relay main contact 7 is opened is described. In contrast, it is possible that the brake device puts brakes when the safety relay main contact is closed. In this case as well, the operation test of the safety relay main contact can be effected.

Also, in the above example, the safety relay main contact for operating the brake device provided to the hoisting machine is used. However, the present invention is also applicable to, for example, a safety relay main contact for operating a rope brake holding a main rope to brake a car or a safety mounted to a car or balance weight.

Further in the above example, the operation test is carried out each time the car stops, but the timing for the operation test is not limited thereto. For example, a counter for counting the number of times the car stops may be provided to the detection circuit main body, and the operation test may be carried out every preset number of stops. In addition, a timer may be provided to the detection circuit main body, and the operation test may be carried out at the timing when the car stops first after the elapse of the preset time period. Further, the operation test may be carried out only when the elevator comes into normal operation (start-up). Furthermore, the operation test may be effected only when the car arrives at a preset floor.

The invention claimed is:

1. An elevator safety device, comprising:

a safety circuit including a safety relay main contact for operating a brake device for braking a car, and a bypass relay main contact that is parallel-connected with the safety relay main contact and that opens during a normal operation; and a detection circuit for generating, while the car is stopped during the normal operation, a safety relay instruction signal for operating the safety relay main contact in a direction that activates the brake device, and for detecting that the safety relay main contact is operated in response to the safety relay instruction signal.

2. The elevator safety device according to claim 1, wherein the detection circuit includes a safety relay monitor contact that opens or closes mechanically in conjunction with the safety relay main contact, and the detection circuit detects a state of the safety relay main contact based on a state of the safety relay monitor contact.

3. The elevator safety device according to claim 1, wherein:

the safety relay main contact closes during the normal operation and opens under an abnormal elevator operation; and the detection circuit generates, when generating the safety relay instruction signal, a bypass instruction signal for closing the bypass relay main contact prior to the generation of the safety relay instruction signal.

4. The elevator safety device according to claim 3, wherein the detection circuit includes a bypass relay monitor contact that opens or closes mechanically in conjunction with the bypass relay main contact and detects a state of the bypass relay main contact based on a state of the bypass relay monitor contact.

5. The elevator safety device according to claim 3, wherein the detection circuit detects whether or not the bypass relay main contact is operated in response to the bypass instruction signal.

6. The elevator safety device according to claim 1, wherein the detection circuit outputs, when an abnormality of the safety relay main contact is detected, an abnormality detection signal to an elevator controller for controlling an operation of an elevator.

7. A method of testing an operation of an elevator safety device that includes a safety relay main contact for operating a brake device for braking a car, comprising:

detecting a state where the car stops during a normal operation and a bypass relay main contact that is parallel-connected with the safety relay main contact is open;

generating, while the car is stopped, a safety relay instruction signal for operating the safety relay main contact in a direction that that activates the brake device; and detecting that the safety relay main contact is operated in response to the safety relay instruction signal.

8. The method of testing an operation of an elevator safety device according to claim 7, wherein the generating and the detecting are performed each time the car stops.

9. The method of claim 7 further comprising:

closing the safety relay during the normal operation and opening the safety relay under an abnormal elevator operation; and outputting a bypass instruction signal for closing the bypass relay main contact prior to the generating.

10. The method of claim 9 further comprising:

detecting whether the bypass relay main contact is operated in response to the bypass instruction signal.

11. The method of claim 7 further comprising:

opening or closing a bypass relay monitor contact in conjunction with the bypass relay main contact; and detecting a state of the bypass relay main contact based on a state of the bypass relay monitor contact.

12. The method of claim 7 further comprising:

outputting an abnormality detection signal to an elevator controller when an abnormality of the safety relay main contact is detected.

* * * * *